US006597445B2

(12) United States Patent
Sugimoto

(10) Patent No.: US 6,597,445 B2
(45) Date of Patent: Jul. 22, 2003

(54) APPARATUS FOR DECIDING POSITION OF SEAM OF GOLF BALL

(75) Inventor: Kazushige Sugimoto, Kobe (JP)

(73) Assignee: Sumitomo Rubber Industries, Ltd., Hyogo-ken (JP)

( * ) Notice: Subject to any disclaimer, the term of this patent is extended or adjusted under 35 U.S.C. 154(b) by 0 days.

(21) Appl. No.: 09/862,695

(22) Filed: May 23, 2001

(65) Prior Publication Data

US 2002/0004430 A1 Jan. 10, 2002

(30) Foreign Application Priority Data

Jun. 19, 2000 (JP) ..... 2000-182754

(51) Int. Cl.[7] ..... G01N 21/00; G06K 9/00

(52) U.S. Cl. ..... 356/237.1; 356/394; 356/398; 382/141; 451/6; 451/8

(58) Field of Search ..... 356/237.1–237.3, 356/426, 394, 398; 382/141, 152, 100; 73/865.8; 219/121.68, 121.69; 264/161, 162; 451/6, 8, 49–50

(56) References Cited

U.S. PATENT DOCUMENTS 4,779,387 A 10/1988 Reid et al.
4,894,958 A 1/1990 Takasaki
5,190,294 A * 3/1993 Oka ..... 246/293
5,360,314 A * 11/1994 Provost et al. ..... 414/755
5,494,631 A * 2/1996 Oka et al. ..... 246/161
5,611,723 A * 3/1997 Mitoma et al. ..... 451/6
6,031,933 A * 2/2000 Kumagai ..... 356/426
6,248,974 B1 * 6/2001 Wai ..... 219/121.69

FOREIGN PATENT DOCUMENTS

JP A60232861 11/1985
JP 01 175 872 * 7/1989
JP A8229810 9/1996

* cited by examiner

*Primary Examiner*—Frank G. Font
*Assistant Examiner*—Sang H. Nguyen
(74) *Attorney, Agent, or Firm*—Birch, Stewart, Kolasch & Birch, LLP

(57) ABSTRACT

A seam position deciding apparatus (1) comprises a light source (3), a camera (5) and a computer (7). The computer (7) has operating means (for example, a CPU) and storage means (for example, an RAM) provided therein. Rays are irradiated from the light source (3) toward a golf ball (9). The golf ball (9) is rotated. The camera (5) photographs the golf ball (9). Data on an image thus photographed have a white pixel and a black pixel. If there is the white pixel in a predetermined region of the image, it is decided that a seam is not horizontal. On the other hand, if there is no white pixel in the same region, it is decided that the seam is horizontal. In the seam position deciding apparatus (1), it is possible to decide, with high precision, whether or not the seam of the golf ball (9) is placed in a predetermined position.

5 Claims, 5 Drawing Sheets

APPARATUS FOR DECIDING POSITION OF SEAM OF GOLF BALL

BACKGROUND OF THE INVENTION

1. Field of the Invention

The present invention relates to an apparatus for deciding whether or not a seam of a molded golf ball is placed in a predetermined position in order to remove a spew present on the same seam.

2. Description of the Related Art

Usually, a golf ball is molded by upper and lower molds comprising semispherical cavities, respectively. For a molding method, injection molding, compression molding and the like are employed. In any of the molding methods, it is impossible to prevent a material (rubber, synthetic resin or the like) from slightly leaking out of a parting line of the upper and lower molds. Accordingly, a ring-shaped spew formed of the material is generated in a portion (hereinafter referred to as a "seam") corresponding to the parting line on the surface of the molded golf ball. The golf ball obtained immediately after the molding has a golf ball body and a spew present on the seam over the surface of the golf ball body. The spew should be removed.

The spew is removed by rotating the golf ball chucked by a holding member and causing the spew to abut on a cutting tool such as a grindstone, a sandpaper or a cutter blade. During the rotation of the golf ball, the positional relationship between the spew and the cutting tool should be maintained to be constant. For this reason, the golf ball is chucked such that a rotation axis is orthogonal to a plane including a seam. The golf ball is usually chucked such that the seam is maintained to be horizontal or vertical.

The golf ball has been chucked manually for a long time. Therefore, a work efficiency has been poor and the cost of manufacture of the golf ball has been increased.

There has also been proposed a spew removing apparatus for mechanically positioning a golf ball without depending on a handwork such that a seam is horizontal (positioning step) and then cutting a spew (cutting step). Such a spew removing apparatus has been disclosed in Japanese Laid-Open Patent Publication No. Sho 59-81059 (1984/81059), Japanese Laid-Open Patent Publication No. Sho 60-232861 (1985/232861), Japanese Laid-Open Patent Publication No. Sho 63-174801 (1988/174801), Japanese Laid-Open Patent Publication No. Sho 63-11266 (1988/11266) and Japanese Laid-Open Patent Publication No. Hei 8-229810 (1996/229810). In these spew removing apparatuses, however, the precision of the positioning step is insufficient. In some golf balls obtained through the positioning step, accordingly, a seam is not horizontal. If the seam is not horizontal, the spew cannot be removed completely at a subsequent cutting step or a portion other than the seam on the surface of the golf ball abuts on a cutting tool and is thereby cut. Consequently, a defective product is manufactured.

In order to prevent the defective product from being manufactured, the step of deciding whether or not the seam is placed in a predetermined position (for example, horizontally) is provided between the positioning step and the cutting step. Only a golf ball decided to have a seam which is horizontal is transferred to the cutting step and a golf ball decided to have a seam which is not horizontal is returned to the positioning step again. For such deciding means, there has been known means for rotating a golf ball after the positioning step and deciding the presence of a seam in a contact portion through a vibration sensor to come in contact with the surface of the golf ball. Moreover, there has also been used means for deciding the presence of a seam in a predetermined position through a fluctuation in a voltage signal of infrared rays or the like. However, any means often makes an erroneous decision. Therefore, it has been desirable that the precision in a decision should be enhanced in respect of a reduction in the rate of generation of defective products.

SUMMARY OF THE INVENTION

In consideration of such circumstances, it is an object of the present invention to provide a seam position deciding apparatus capable of deciding, with high precision, whether or not a seam is placed in a predetermined position and a method of manufacturing a golf ball using the seam position deciding apparatus.

In order to achieve the above-mentioned object, the present invention provides an apparatus for deciding whether or not a seam is placed in a predetermined position, comprising a camera for photographing a golf ball having a spew present on the seam thereof, and operating means for deciding presence of a spew in a predetermined region of an image photographed by the camera.

In the seam position deciding apparatus, whether the seam is placed in the predetermined position is decided based on the image photographed by the camera. In the deciding method, precision in a decision is more excellent than that in a conventional deciding method. The decision is made based on the numbers of black pixels and white pixels in the predetermined region of the image.

Preferably, the photographing is carried out by the camera while the golf ball is rotated and it is decided whether or not the seam is placed in the predetermined position. Consequently, the rate of an erroneous decision can be reduced still more.

The seam position deciding apparatus is excellent in the precision in a decision. In a golf ball manufacturing method using the seam position deciding apparatus, therefore, the rate of generation of defective products can be reduced.

DESCRIPTION OF THE PREFERRED EMBODIMENTS

The present invention will be described below in detail based on a preferred embodiment with reference to the drawings.

Figure 1:
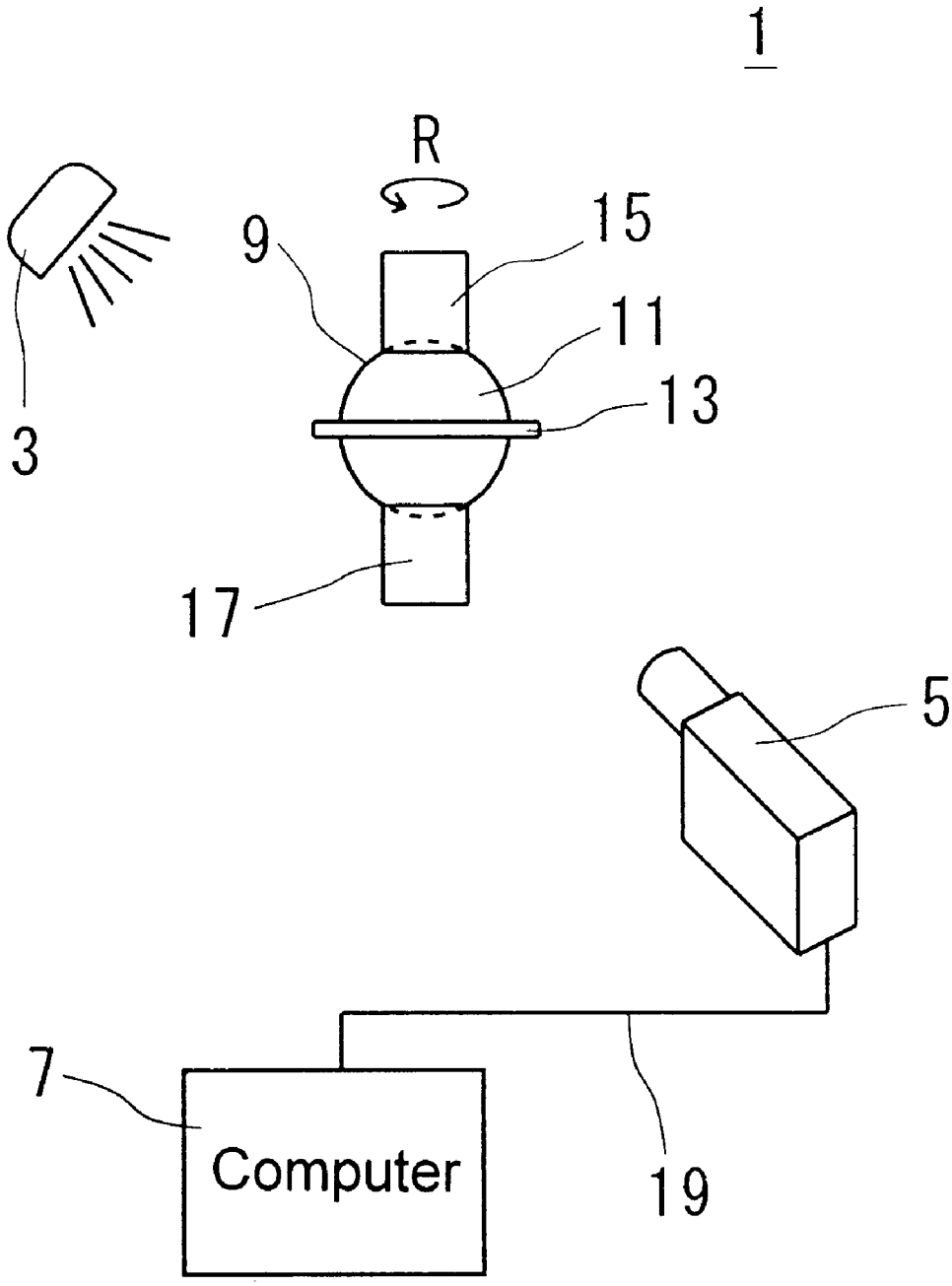
FIG. 1 is a typical perspective view showing a seam position deciding apparatus according to an embodiment of the present invention.

FIG. 1 is a typical perspective view showing a seam position deciding apparatus 1 according to an embodiment of the present invention. The seam position deciding apparatus 1 comprises a light source 3, a camera 5 and a computer 7. The computer 7 has operating means (for example, a CPU) and storage means (for example, an RAM) provided therein.

FIG. 1 also shows a golf ball 9 obtained after molding (accordingly, which is not subjected to a processing such as painting). The golf ball 9 comprises a golf ball body 11 and a ring-shaped spew 13. The golf ball 9 is chucked by an upper holding tool 15 and a lower holding tool 17. The golf ball 9 is also rotated with rotation of either or both of the upper holding tool 15 and the lower holding tool 17 as shown in an arrow R of FIG. 1.

The light source 3 is positioned obliquely above the golf ball 9 and rays are irradiated from the light source 3 toward the golf ball 9. When the golf ball 9 is illuminated with the rays, the golf ball 9 is clearly distinguished from the background in a photographed image as will be described below in detail. The type of the light source 3 is not particularly restricted but an incandescent lamp or the like can be used, for example. As a matter of course, the light source 3 does not need to be provided in the environment which is sufficiently bright through natural light or the like.

The type of the camera 5 is not particularly restricted but a CCD camera can be suitably used, for example. The camera 5 is connected to the computer 7 through a cable 19. Image data obtained by the camera 5 are stored in the storage means of the computer 7. Then, the operating means decides the presence of the spew 13 in a predetermined region based on the image data as will be described below in detail. Specific examples of the suitable camera 5 include "CV-C1" (trade name) produced by Keyence Corporation. Moreover, specific examples of the suitable operating means include "CV-100" (trade name) produced by the Keyence Corporation.

Figure 2:
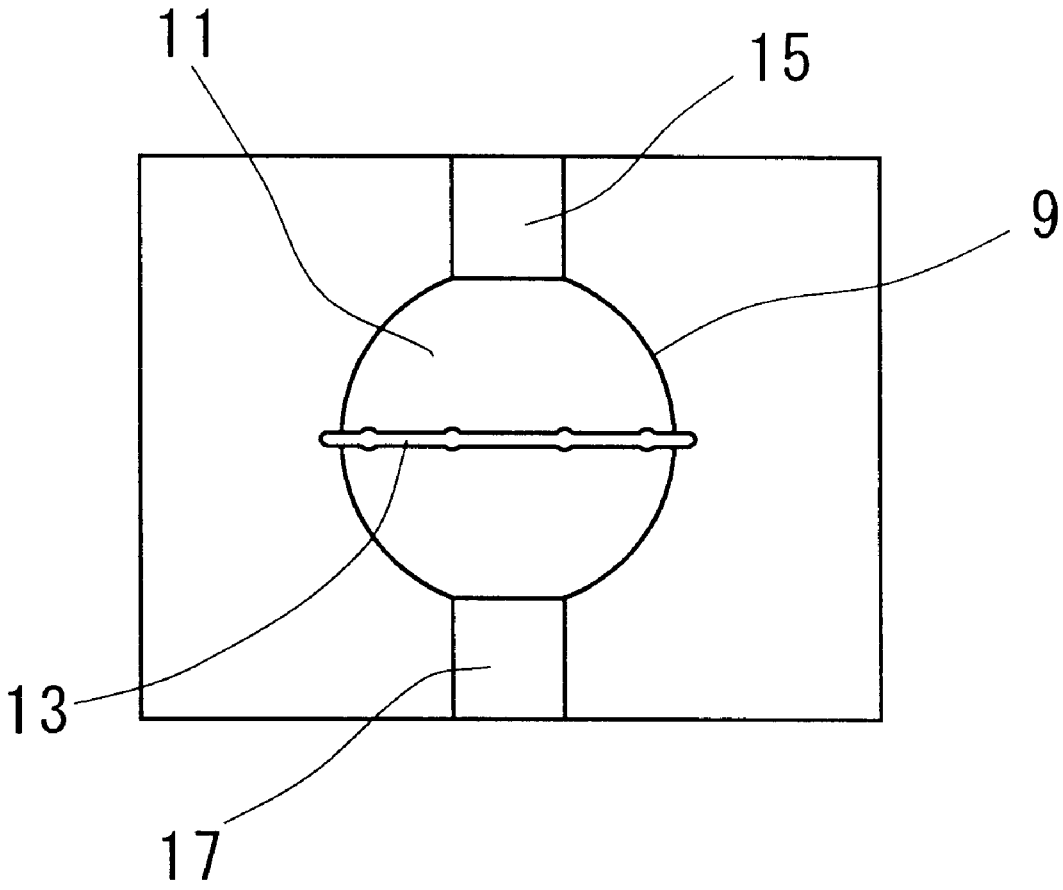
FIG. 2 is a front view showing an image photographed by a camera in FIG. 1.

FIG. 2 is a front view showing an image photographed by the camera 5 in FIG. 1. The image has white and black pixels. More specifically, data on the image are made binary. On the image, the golf ball 9, the upper holding tool 15 and the lower holding tool 17 are photographed. The rays are irradiated on the golf ball 9 (that is, the golf ball body 11 and the spew 13) as described above. Therefore, the golf ball 9 is photographed to be white on the image through the reflected light of the rays. On the other hand, since the background has no reflected light, it is photographed to be black. The upper holding tool 15 and the lower holding tool 17 are usually formed of a metal. In some cases, therefore, the upper holding tool 15 and the lower holding tool 17 are also photographed to be slightly white through the reflection of rays. However, it is possible to distinguish the golf ball 9 from the upper holding tool 15 and lower holding tool 17 through regulation of the light receiving level of the camera 5. Such photographing is carried out while the golf ball 9 is rotated a predetermined number of times (for example, once).

Figure 3:
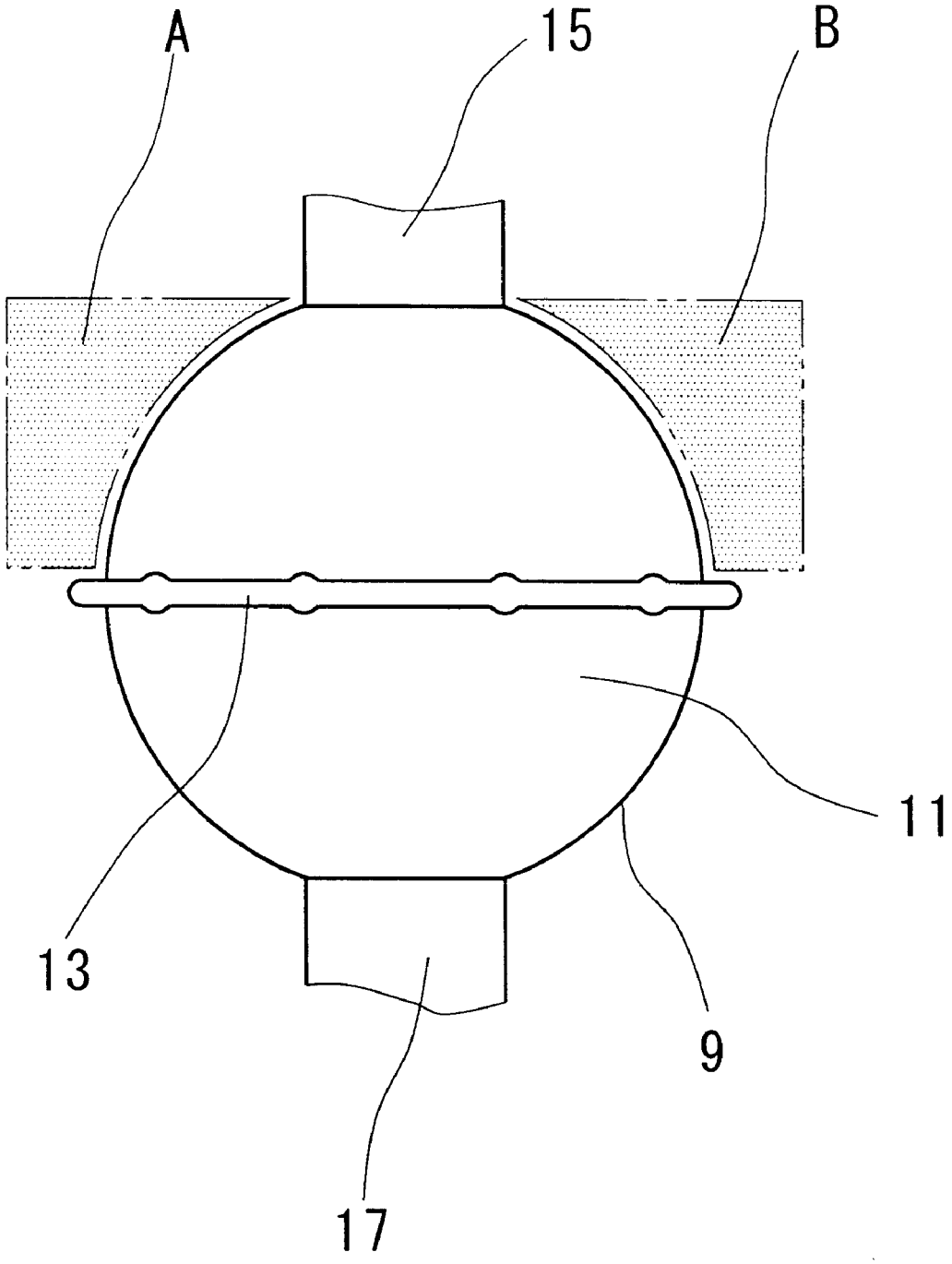
FIG. 3 is a partial enlarged view showing an example of the image photographed by the camera in FIG. 1.

FIG. 3 is a partial enlarged view showing an example of the image photographed by the camera 5 in FIG. 1. FIG. 3 illustrates the golf ball 9 having the spew 13 (that is, a seam) extended horizontally. In FIG. 3, pixels are counted in dotted A and B regions. The innermost sides of the A and B regions (which are close to the golf ball 9) are provided along the contour of the golf ball body 11 slightly apart from the golf ball body 11. Moreover, the A and B regions are provided slightly upward apart from the spew 13. Since only the background is photographed in the A and B regions, and the spew 13 is distributed horizontally, even if the golf ball 9 is rotated, the A and B regions do not include the golf ball body 11 or the spew 13. In other words, the A and B regions do not include a white pixel at all and all the pixels in the A and B regions are black.

Figure 4:
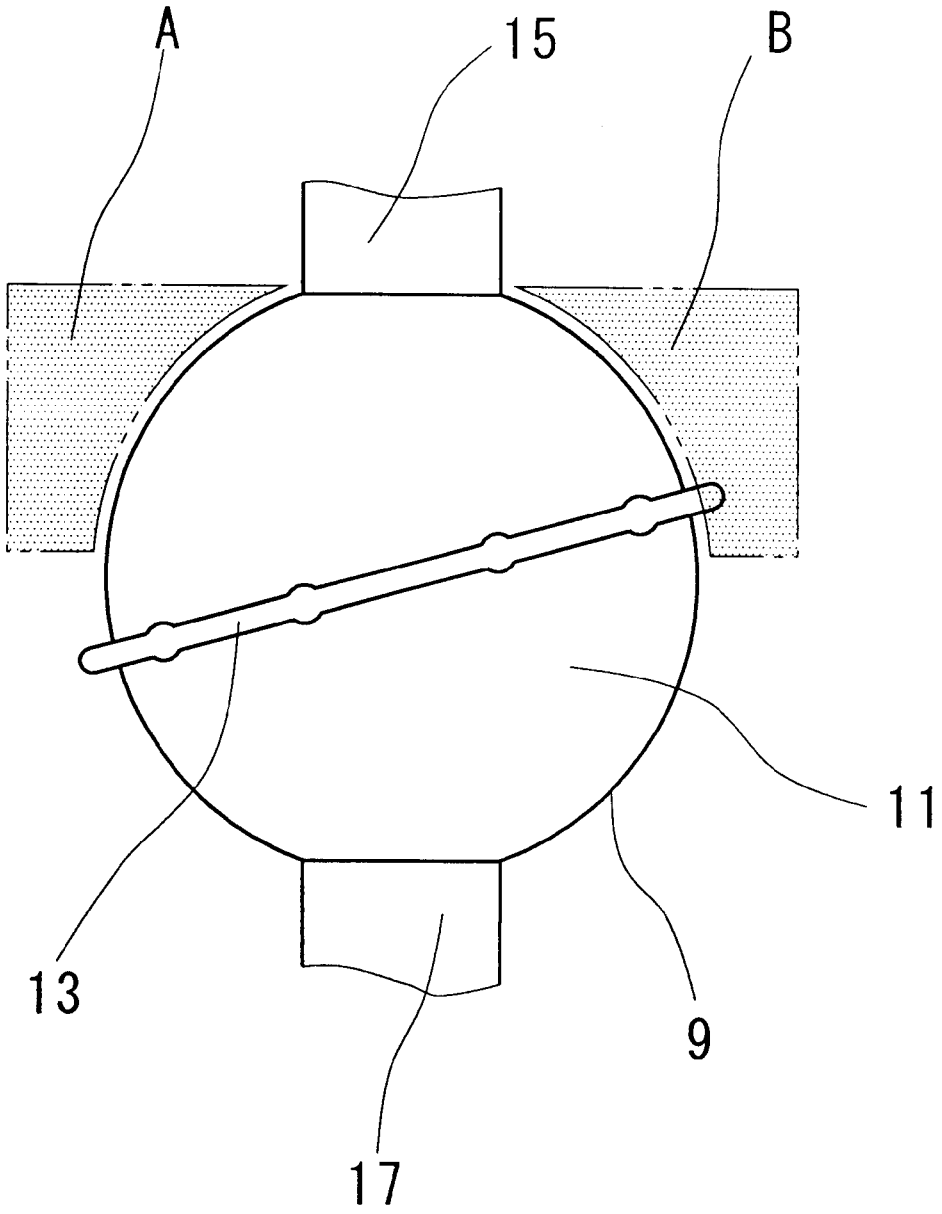
FIG. 4 is a partial enlarged view showing another example of the image photographed by the camera in FIG. 1.

FIG. 4 is a partial enlarged view showing another example of the image photographed by the camera 5 in FIG. 1. In FIG. 4, the spew 13 (that is, a seam) is not provided horizontally but rightward and upward. FIG. 4 also shows the A and B regions in the same manner as FIG. 3. In the A and B regions, pixels are counted. In FIG. 4, the B region includes the spew 13. The spew 13 is photographed to be white as described above. Therefore, the B region includes some white pixels together with black pixels mostly occupying the B region. In the A region, all the pixels are black. When the golf ball 9 is rotated by approximately 180 degrees together with the upper holding tool 15 and the lower holding tool 17 in the state shown in FIG. 3, the A region is caused to include the spew 13. At this time, the A region includes some white pixels together with the black pixels mostly occupying the A region.

As is apparent from the comparison of FIG. 3 with FIG. 4, the A and B regions do not include the white pixel if the seam is horizontal, and the A or B region always includes the white pixel if the seam is not horizontal. Accordingly, when the number of the white pixels in the A and B regions which is counted by the operating means of the computer 7 is zero while the golf ball 9 is rotated, it is decided that the seam is horizontal (that is, "pass"). When the number of the white pixels in the A and B regions is 1 or more, it is decided that the seam is not horizontal (that is, "fail").

In the actual golf ball 9, a diameter of the golf ball body 11, a sphericity of the golf ball body 11 and a thickness or length of the spew 13 have variations. Moreover, buffing powder (powder of the spew 13 which has been cut) or the like sticks to the surface of the golf ball body 11 or the lens of the camera 5 in some cases. Accordingly, the seam position deciding apparatus 1 may be constituted such that the decision of "pass" or "fail" is not carried out depending on whether the number of the white pixels is zero or 1 or more but a predetermined point (for example, a 10-point) is set to be a borderline, and it is decided to be "pass" if the number of the white pixels which is counted is smaller than the predetermined point and it is decided to be "fail" if the same number is equal to or greater than the predetermined point. Other factors to influence the borderline include positions where the A and B regions are to be set, the light receiving level of the camera 5, the brightness of the light source 3, the size of a pixel (resolution), the size of an image and the like.

The decision of "pass" and "fail" may be carried out based on one static image without the rotation of the golf ball 9. In this case, the golf ball 9 having an oblique seam is decided to be "pass" very rarely. More specifically, when the lowest or highest portion of the spew 13 is set to be the front face of the camera 5, the A and B regions do not include the spew 13 irrespective of the oblique seam. Accordingly, it is preferable that an image should be obtained while rotating the golf ball 9 as described above. As a matter of course, it is possible to enhance the precision in a decision by obtaining two or more images in different directions through two or more cameras 5 to count the white pixels without the rotation of the golf ball 9.

The seam position deciding apparatus 1 described above is only illustrative. For example, the setting of the region where the pixels are to be counted, the type of the camera 5, the method of deciding "pass" or "fail" can be properly changed depending on the circumstances.

Figure 5:
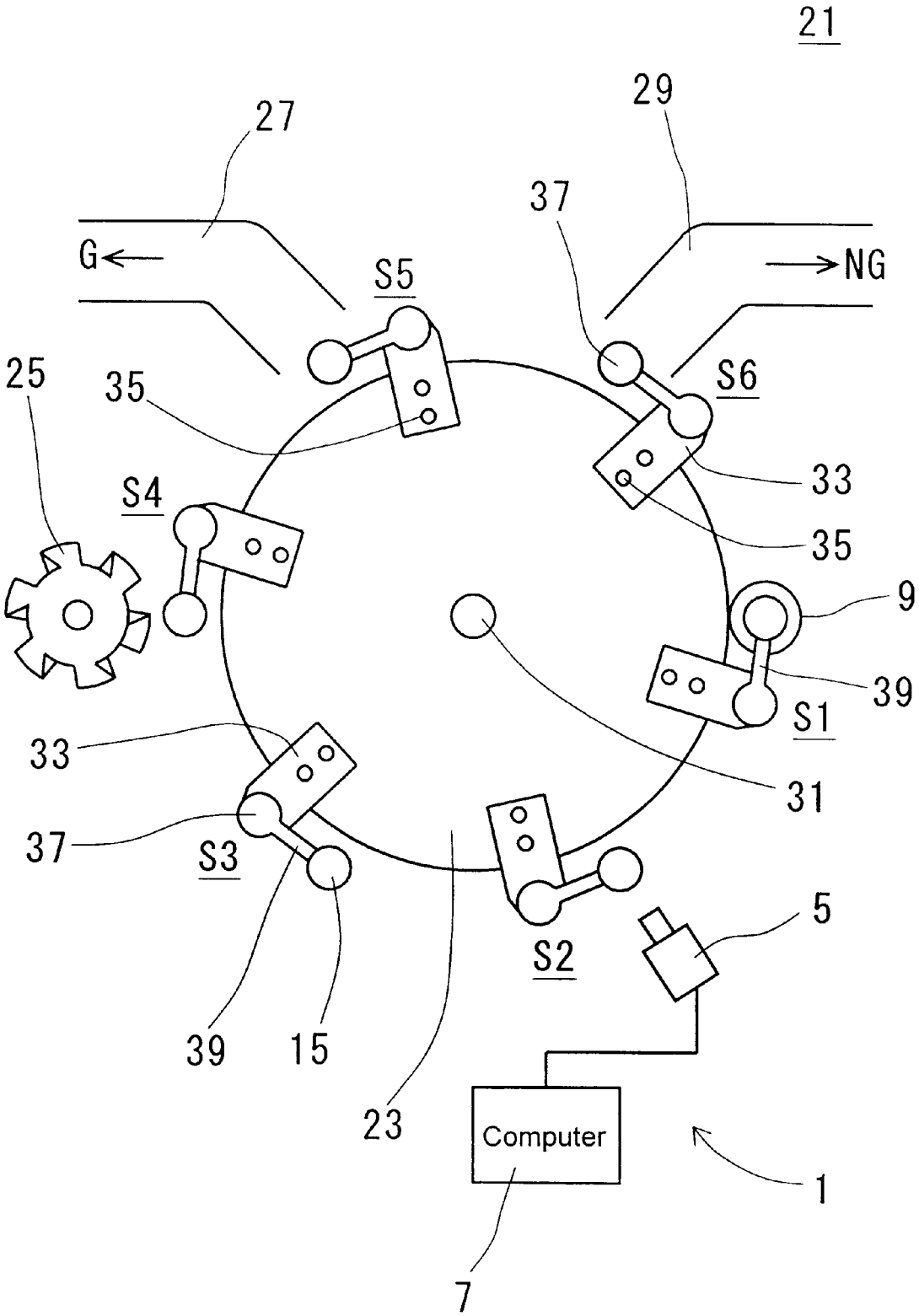
FIG. 5 is a typical top view showing a spew removing apparatus incorporating the seam position deciding apparatus in FIG. 1.

FIG. 5 is a typical top view showing a spew removing apparatus 21 incorporating the seam position deciding apparatus 1 in FIG. 1. The spew removing apparatus 21 comprises the camera 5 and the computer 7 which act as the seam position deciding apparatus 1, a turntable 23, a cutting tool 25, a first path 27, and a second path 29. The seam position deciding apparatus 1 also comprises the light source 3 (see FIG. 1) which is not shown in FIG. 5.

The turntable 23 is disc-shaped and includes a center shaft 31. The center shaft 31 is extended in a vertical direction (in a perpendicular direction to the paper of FIG. 5) and is rotated clockwise in FIG. 5. The rotation of the center shaft 31 is intermittently carried out every 60 degrees. Consequently, the turntable 23 is also turned intermittently every 60 degrees. Six base plates 6 are fixed to the turn table 23 at regular intervals with a bolt 35. Each base plate 33 is stopped at a first station (S1), a second station (S2), a third station (S3), a fourth station (S4), a fifth station (S5) and a sixth station (S6) through the intermittent turning operation of the turntable 23. A center rod 37 is rotatably attached pivotally to the base plate 33 on the tip of the base plate 33. An upper arm 39 is extended from the center rod 37 and the upper holding tool 15 is rotatably attached pivotally to the tip of the upper arm 39. A lower arm is provided under the upper arm 39 and the lower holding tool 17 (see FIG. 1) is provided under the upper holding tool 15, which is not shown in FIG. 5.

When the golf ball 9 is to be manufactured by using the spew removing apparatus 21, a seam is first positioned horizontally through a well-known horizontal positioning device (which has been disclosed in Japanese Laid-Open Patent Publication No. Sho 59-81059 (1984/81059, for example). The golf ball 9 is chucked by the upper holding tool 15 and the lower holding tool 17 at the first station (S1).

The golf ball 9 is moved to the second station (S2) through the turning operation of the turntable 23. At the second station (S2), the golf ball 9 is rotated and is photographed by the camera 5. Image data thus obtained are transmitted to the computer 7 and the pass and fail decision (whether the seam is horizontal or not) is carried out by the above-mentioned method. The golf ball 9 subjected to the decision is sent to the third station (S3) through the turning operation of the turntable 23, and furthermore, to the fourth station (S4). The third station (S3) is a so-called dummy station where any processing is not carried out for the golf ball 9.

The golf ball 9 decided to be the "pass" at the second station (S2) is sent to the fourth station (S4) where the spew 13 is cut and removed. The cutting and removing operation is carried out through the abutment of the spew 13 on the cutting tool 25 while the golf ball 9 is rotated. On the other hand, the golf ball 9 decided to be the "fail" at the second station (S2) is sent to the fourth station (S4) where a distance between the spew 13 and the cutting tool 25 is increased so that the cutting is not carried out. Consequently, it is possible to prevent a defective product from being manufactured.

At the fifth station (S5), only the golf ball body 11 decided to be the "pass" (from which the spew 13 is removed) is taken away and is transmitted to a next step (for example, a surface treating step, a painting step, a marking step and the like) through the first path 27 as shown in an arrow G of FIG. 5. The golf ball 9 decided to be the "fail" (which has the spew 13 removed) passes through the fifth station (S5).

The golf ball 9 decided to be the "fail" is taken away at a sixth station (S6). Then, the golf ball 9 is returned to the horizontal positioning step through the second path 29 as shown in an arrow NG of FIG. 5. Then, the golf ball 9 is positioned horizontally again. The golf ball 9 positioned horizontally is transmitted to the first station (S1) again. While the golf ball 9 in only the first station (S1) is shown in FIG. 5, the golf ball 9 is chucked by all the holding members appearing successively in the first station (S1). Accordingly, the golf ball 9 is present at least from the second station to the fourth station.

The seam position deciding apparatus described above has high precision in a decision. By using the seam position deciding apparatus for the manufacture of the golf ball, a defective ratio can be reduced.

The above description is only illustrative and can be variously changed without departing from the scope of the present invention.

What is claimed is:

1. An apparatus for deciding whether or not a seam is placed in a predetermined position, comprising:

a camera for photographing a profile of a golf ball having a spew present on the seam; and operating means for detecting the spew in a predetermined region of a stored image of a background of the golf ball, wherein the operating means detects that the seam is in the predetermined region of the stored image of the background of the golf ball by counting numbers of pixels in the predetermined region of binary data of the image of the background of the golf ball.

2. The apparatus according to claim 1, wherein the decision of the operating means is made based on the numbers of black and white pixels in the predetermined region of the image.

3. The apparatus according to claim 1, wherein the photographing is carried out by the camera while the golf ball is rotated.

4. A method of manufacturing a golf ball comprising the steps of:

deciding whether or not a seam is placed in a predetermined position by an apparatus including a camera for photographing a profile of the golf ball having a spew present on said seam and operating means for detecting the spew in a predetermined region of a stored image of a background of the golf ball; and removing the spew of the golf ball which is decided to have the seam placed in the predetermined position, wherein the deciding step includes photographing the golf ball and creating a circular-shaped profile of the golf ball to be compared with a semi-circular arc portion of the stored image of the background of the golf ball, the presence of the seam being determined when white pixels on the stored image of the background of the golf ball are counted and found to be in excess of a predetermined number.

5. An apparatus for deciding whether a seam is placed in a predetermined position, comprising:

a camera for photographing a golf ball having a spew present on the seam, the camera being aimed at a center of the golf ball in order to create a circular-shaped profile of the golf ball; and operating means for detecting the spew in a predetermined region of a stored image of a background of the golf ball, the stored image having a semi-circular portion, wherein the operating means detects the seam in the predetermined region of the stored image of the background of the golf ball by comparing the profile of the golf ball with the stored image of the background of the golf ball based a number of white pixels in the predetermined region of the image of the back round of the golf ball.

* * * * *